US008444718B2

(12) United States Patent
Clark et al.

(10) Patent No.: US 8,444,718 B2
(45) Date of Patent: May 21, 2013

(54) PROCESS TO PREPARE AN AVIATION FUEL

(75) Inventors: Richard Hugh Clark, Chester (GB); Richard Michael Jory, London (GB); Richard James Stradling, Ince (GB); Robert Wilfred Matthews Wardle, Ince (GB)

(73) Assignee: Shell Oil Company, Houston, TX (US)

( * ) Notice: Subject to any disclaimer, the term of this patent is extended or adjusted under 35 U.S.C. 154(b) by 1307 days.

(21) Appl. No.: 11/692,757

(22) Filed: Mar. 28, 2007

(65) Prior Publication Data

US 2008/0282603 A1 Nov. 20, 2008

(30) Foreign Application Priority Data

Mar. 29, 2006 (EP) ..... 06111886

(51) Int. Cl.
*C10L 1/04* (2006.01)
*C10G 7/00* (2006.01)

(52) U.S. Cl.
USPC ..... 44/300; 208/15; 208/347; 208/370; 208/950

(58) Field of Classification Search
USPC ..... 44/300; 208/15, 19, 950
See application file for complete search history.

(56) References Cited

U.S. PATENT DOCUMENTS

| | | | | | |
|---|---|---|---|---|---|
| 3,230,164 | A * | 1/1966 | Williams, III et al. | ..... | 208/89 |
| 4,172,815 | A * | 10/1979 | Jacobs | ..... | 208/111.3 |
| 4,645,585 | A * | 2/1987 | White | ..... | 208/58 |
| 4,723,963 | A * | 2/1988 | Taylor | ..... | 44/436 |
| 2007/0265479 | A1 * | 11/2007 | Landschof | ..... | 585/14 |

FOREIGN PATENT DOCUMENTS

| | | |
|---|---|---|
| EP | 0147873 | 3/1988 |
| EP | 0583836 | 2/1994 |
| GB | 2077289 | 12/1981 |
| WO | WO0011117 | 3/2000 |
| WO | WO03087273 | 10/2003 |
| WO | WO2004104142 | 12/2004 |

OTHER PUBLICATIONS

British Ministry of Defence Standard DEF STAN 91-91/Issue 5 of 8 Feb. 2005 for Turbine Fuel, Aviation "Kerosene Type", Jet A-1, NATO code F-35, Joint Service Designation AVTUR.

* cited by examiner

*Primary Examiner* — Ellen McAvoy
*Assistant Examiner* — Ming Cheung Po

(57) ABSTRACT

A process to prepare an aviation fuel and an automotive gas oil from a source of mineral derived gas oil is provided. From the mineral derived gas oil a low boiling fraction is isolated for use as an aviation fuel or as an aviation fuel component and the remaining part of the mineral derived gas oil is blended with a Fischer-Tropsch derived kerosene fraction and/or a Fischer-Tropsch derived gas oil fraction to obtain a blend suited for use as at least part of an automotive gas oil.

15 Claims, No Drawings

PROCESS TO PREPARE AN AVIATION FUEL

FIELD OF THE INVENTION

The present invention is directed to a process to prepare an aviation fuel.

BACKGROUND OF THE INVENTION

Processes to prepare aviation fuel are performed in a refinery environment wherein from a crude mineral oil source an aviation fuel and an automotive gas oil are prepared. Typically the crude mineral oil is separated by means of distillation into a distillate kerosene fraction boiling in the aviation fuel range and a distillate gas oil fraction boiling in the automotive gas oil range. If required, these fractions are subjected to hydroprocessing to reduce sulphur and nitrogen levels. In more complex refineries, higher boiling fractions and residual fractions of the crude oil are subjected to conversion processes involving optionally hydrogen, wherein part of the high boiling compounds are converted, i.e. cracked, to lower boiling compounds boiling in the respective aviation fuel and automotive gas oil ranges. In order to achieve a finished fuel product, blends of the aforementioned sources of kerosene and gas oil fractions are made. A refinery operation as above typically involves a complex scheduling operation whereby, depending on the crude oil feed and the desired oil products, an optimal processing and blending scheme results. When preparing aviation fuel products and gas oil in a summer period from a crude oil source, scheduling problems have to be solved. In a summer period there is a higher need for aviation fuel due to an increase in the holiday travel as compared to the winter period.

SUMMARY OF THE INVENTION

Accordingly, there is provided a process to prepare an aviation fuel and an automotive gas oil from a source of mineral derived gas oil comprising the steps of isolating a low boiling fraction from the mineral derived gas oil for use as an aviation fuel or as an aviation fuel component and blending the remaining part of the mineral derived gas oil with a Fischer-Tropsch derived kerosene fraction and/or a Fischer-Tropsch derived gas oil fraction thereby providing a blend suited for use as at least part of an automotive gas oil.

DETAILED DESCRIPTION OF THE INVENTION

The present invention aims at providing a technical solution for the above scheduling problem. The invention is also directed to a process to prepare an aviation fuel in combination with an automotive gas oil from a source of mineral derived kerosene and a source of mineral derived gas oil.

In accordance with the present invention there is provided a process to prepare an aviation fuel and an automotive gas oil from a source of mineral derived gas oil, wherein from the mineral derived gas oil a low boiling fraction is isolated for use as an aviation fuel or as an aviation fuel component and wherein the remaining part of the mineral derived gas oil is blended with a Fischer-Tropsch derived kerosene fraction and/or a Fischer-Tropsch derived gas oil fraction to obtain a blend suited for use as at least part of an automotive gas oil.

Applicants found that the low boiling fraction of the mineral gas oil is suited as an aviation fuel. By blending the remaining higher boiling fraction of the mineral gas oil with a Fischer-Tropsch kerosene or with a Fischer-Tropsch gas oil, or with combinations of these, a fuel is obtained which in turn is suited for use as an automotive gas oil fuel. A further advantage of using such a Fischer-Tropsch fraction is that the resulting cetane number of the Fischer-Tropsch and mineral oil derived gas oil fuel will be higher than the starting mineral derived gas oil fraction. Adding the Fischer-Tropsch derived kerosene to increase the volume of aviation fuel is less attractive because less use would be made of the intrinsic high cetane number contribution of the Fischer-Tropsch kerosene ranging from 63 to 75 as measured by IP 498[IQT].

Another advantage of exchanging a relatively dense mineral kerosene fraction of the mineral gas oil for a relatively less dense Fischer-Tropsch derived kerosene or gas oil is that the refinery scheduler may add additional cracked gas oil blending components to the final gas oil blend while remaining in the density specifications for the finished fuel.

Cracked gas oils are the gas oil fractions obtained in any process, thermal or catalytic, which is operated in the absence of added hydrogen. Such processes are sometimes referred to as carbon rejection processes. Examples of such processes are the fluid catalytic cracking (FCC) process and thermal cracking and vis-breaking processes, which are all well known refinery processes. Cracked gas oils are characterised in that they cannot be qualified as automotive gas oil fuel if used as the only gas oil component. More especially, the cracked gas oils will have a density at 15° C. of greater than 845 kg/m$^3$ and/or a cetane number of less than 51. One may advantageously add cracked gas oils, which have a density at 15° C. of greater than 845 kg/m$^3$, more especially greater than 860 kg/m$^3$, and a cetane number of less than 51, more especially less than 45. The upper limit for the density at 15° C. of the cracked gas oil is typically 920 kg/m$^3$ and the lower limit for the cetane number of the cracked gas oil is typically 25. The cracked gas oil is preferably subjected to a hydrodesulphurisation process in order to reduce the sulphur content to a value of below 1000 ppmw, more preferably to a value of below 500 ppmw and even more preferably below 100 pppmw.

Such cracked gas oil blending components are difficult to use in automotive gas oil applications because of their high density, high aromatics and low cetane number contribution. By using the Fischer-Tropsch derived fuels, having low density, low aromatics and a high cetane number contribution, most of the disadvantages of using such high-density gas oil blending fractions are overcome. The volume of cracked gas oil which may be added will be determined by the fuel specifications, especially density.

Fischer-Tropsch derived kerosene has the added advantage that it is not only more volatile than conventional diesel base fuels but also has a higher cetane number. These two properties combined have been found to result in better combustion. Better combustion can in turn be manifested in improved acceleration times for a vehicle running on such a fuel composition.

Aviation fuel is a product boiling for more than 90 vol % at from 130 to 300° C., having a density from 775 to 840 kg/m$^3$, preferably from 780 to 830 kg/m$^3$, at 15° C. (e.g. ASTM D4502), an initial boiling point in the range 130 to 160° C. and a final boiling point in the range 220 to 300° C., a kinematic viscosity at −20° C. (ASTM D445) suitably from 1.2 to 8.0 mm$^2$/s and a freeze point of below −40° C., preferably below −47° C.

Aviation fuel will typically meet one of the following standards. Jet A-1 requirements in DEF STAN 91-91 (British Ministry of Defence Standard DEF STAN 91-91/Issue 5 of 8 Feb. 2005 for Turbine Fuel, Aviation "Kerosene Type", Jet A-1, NATO code F-35, Joint Service Designation AVTUR, or versions current at the time of testing) or "Check List" (Aviation Fuel Quality Requirements for Jointly Operated Systems (AFQRJOS) are based on the most stringent requirements of ASTM D1655 for Jet A-1 and DEF STAN 91-91 and some airport handling requirements of the IATA Guidance Material for Aviation Turbine Fuels Specifications. Jet fuel that meets the AFQRJOS is usually referred to as "Jet A-1 to Check List" or "Check List Jet A-1"). Examples of mineral derived kerosenes meeting Jet A-1 requirements and a kerosene stream used in Jet A-1 production are listed in Table 1.

TABLE 1

| |
|---|
| Jet fuel produced by Merox ® process. |
| Hydroprocessed jet fuel, with 19 mg/L of antioxidant Ionox 75 (RDE/A/609). |
| Jet fuel produced by caustic washing of straight run kerosene. |
| Straight run kerosene stream. |

The low boiling fraction as separated from the mineral gas oil may be used as such or in combination with a mineral derived kerosene, suitably made at the same production location. As the low boiling fraction may already comply with the aviation fuel specifications it is evident that the blending ratio between said component and the mineral kerosene may be freely chosen. The mineral derived kerosene will typically boil for more than 90 vol % within the usual kerosene range of 130 to 300° C., depending on grade and use. It will typically have a density from 775 to 840 kg/m$^3$, preferably from 780 to 830 kg/m$^3$, at 15° C. (e.g. ASTM D4502 or IP 365). It will typically have an initial boiling point in the range 130 to 160° C. and a final boiling point in the range 220 to 300° C. Its kinematic viscosity at −20° C. (ASTM D445) might suitably be from 1.2 to 8.0 mm$^2$/s.

The mineral kerosene fraction may be a straight run kerosene fraction as isolated by distillation from said crude mineral oil source or a kerosene fraction isolated from the effluent of typical refinery conversion processes, preferably hydrocracking. The kerosene fraction may also be the blend of straight run kerosene and kerosene as obtained in a hydrocracking process. Suitably the properties of the mineral derived kerosene are those of the desired aviation fuel as defined above.

Automotive gas oil is a fuel which will comply with applicable current standard specification(s), for example EN590: 2004 in Europe. The fuel will suitably have a T95 of from 275 to 360° C., a density of from 820 to 845 kg/m$^3$ at 15° C., a flash point of above 55° C., a cetane number of above 51 and a kinematic viscosity at 40° C. of between 2 and 4.5 cSt (mm$^2$/s). The CFPP (cold filter plugging point) of the fuel is dependent upon the climate in the area of usage, for example in EU below +5° C. in warmer regions and below −20° C. in the colder regions. The aromatic content of the fuel is suitably from 0 to 40 wt %. The sulphur content of the fuel is suitably less than 1000 ppmw, preferably less than 350 ppmw.

The mineral derived gas oil fraction will typically be a mineral crude derived diesel base fuel. Such fuels will typically have boiling points within the usual diesel range of 150 to 400° C. The base fuel will typically have a density from 0.75 to 0.9 g/cm$^3$, preferably from 0.8 to 0.86 g/cm$^3$, at 15° C. (e.g. ASTM D4502 or IP 365) and a cetane number as measured by IP 498[IQT] of from 35 to 80, more preferably from 40 to 75. It will typically have an initial boiling point in the range 150 to 230° C. and a final boiling point in the range 290 to 400° C. Its kinematic viscosity at 40° C. (ASTM D445) might suitably be from 1.5 to 4.5 centistokes (mm$^2$/s).

The mineral derived gas oil fraction may be obtained from refining and optionally (hydro)processing a mineral crude source. It may be a single gas oil stream obtained from such a refinery process or a blend of several gas oil fractions obtained in the refinery process via different processing routes. Examples of such gas oil fractions are straight run gas oil, vacuum gas oil, gas oil as obtained in a thermal cracking process, light and heavy cycle oils as obtained in a fluid catalytic cracking unit and gas oil as obtained from a hydrocracker unit.

Such gas oils may be processed in a hydrodesulphurisation (HDS) unit so as to reduce their sulphur content to a level suitable for inclusion in a diesel fuel composition.

The low boiling fraction of the mineral derived gas oil fraction is defined as the lower boiling part of the above defined mineral gas oil fraction. Preferably the low boiling fraction will comply with the aviation fuel specifications as listed above.

By "Fischer-Tropsch derived" is meant that a fuel is, or derives from, a synthesis product of a Fischer-Tropsch condensation process. The term "non-Fischer-Tropsch derived" may be interpreted accordingly. The Fischer-Tropsch reaction converts carbon monoxide and hydrogen into longer chain, usually paraffinic, hydrocarbons:

$$n(CO+2H_2)=(—CH_2—)_n+nH_2O+\text{heat},$$

in the presence of an appropriate catalyst and typically at elevated temperatures, for example 125 to 300° C., preferably 175 to 250° C., and/or pressures, for example 5 to 100 bar, preferably 12 to 50 bar. Hydrogen:carbon monoxide ratios other than 2:1 may be employed if desired.

The carbon monoxide and hydrogen may themselves be derived from organic or inorganic, natural or synthetic sources, typically from coal, biomass, for example wood chips, residual fuel fractions or more preferably natural gas or from organically derived methane. A Fischer-Tropsch derived fuel is sometimes referred to as a GTL (Gas-to-Liquids) fuel because the most commonly published source of carbon monoxide and hydrogen is natural gas. When in the context of the present invention reference is made to a GTL fuel, also coal or biomass derived fuels are meant.

Fischer-Tropsch derived kerosene or gas oil fraction may be obtained directly from the Fischer-Tropsch reaction, or indirectly, for instance by fractionation of Fischer-Tropsch synthesis products or from hydrotreated Fischer-Tropsch synthesis products. Hydrotreatment can involve hydrocracking to adjust the boiling range as for example described in GB-B-2077289 and EP-A-0147873, and/or hydroisomerisation which can improve cold flow properties by increasing the proportion of branched paraffins. EP-A-0583836 describes a two step hydrotreatment process in which a Fischer-Tropsch synthesis product is firstly subjected to hydroconversion under conditions such that it undergoes substantially no isomerisation or hydrocracking (this hydrogenates the olefinic and oxygen-containing components), and then at least part of the resultant product is hydroconverted under conditions such that hydrocracking and isomerisation occur to yield a substantially paraffinic hydrocarbon fuel. The desired kerosene fraction(s) or gas oil fraction may subsequently be isolated for instance by distillation.

Typical catalysts for the Fischer-Tropsch synthesis of paraffinic hydrocarbons comprise, as the catalytically active component, a metal from Group VIII of the periodic table, in particular ruthenium, iron, cobalt or nickel. Suitable such catalysts are described for instance in EP-A-0583836. The Fischer-Tropsch reactor may be for example a multi-tubular reactor or a slurry reactor.

An example of a Fischer-Tropsch based process is the SMDS (Shell Middle Distillate Synthesis) described in "The Shell Middle Distillate Synthesis Process", van der Burgt et al. This process (also sometimes referred to as the Shell "Gas-To-Liquids" or "GTL" technology) produces middle distillate range products by conversion of a natural gas (primarily methane) derived synthesis gas into a heavy long chain hydrocarbon (paraffin) wax, which can then be hydroconverted and fractionated to produce liquid transport fuels such as the kerosene fractions used in the present invention. A version of the SMDS process, utilizing a fixed bed reactor for the catalytic conversion step, is currently in use in Bintulu, Malaysia. Kerosene and gas oil fractions prepared by the SMDS process are commercially available for instance from Shell companies.

By virtue of the Fischer-Tropsch process, a Fischer-Tropsch derived kerosene or gas oil fraction has essentially no, or undetectable levels of, sulphur and nitrogen. Compounds containing these heteroatoms tend to act as poisons for Fischer-Tropsch catalysts and are therefore removed from the synthesis gas feed. This can yield additional benefits, in terms of effect on catalyst performance, in fuel compositions in accordance with the present invention.

Further, the Fischer-Tropsch process as usually operated produces no or virtually no aromatic components. The aromatics content of a Fischer-Tropsch derived fuel, suitably determined by ASTM D4629, will typically be below 1% w/w, preferably below 0.5% w/w and more preferably below 0.1% w/w.

Generally speaking, Fischer-Tropsch derived kerosene and gas oil fractions have relatively low levels of polar components, in particular polar surfactants, for instance compared to petroleum derived fuels. It is believed that this can contribute to improved antifoaming and dehazing performance in the final automotive gas oil fuel. Such polar components may include for example oxygenates, and sulphur and nitrogen containing compounds. A low level of sulphur in a Fischer-Tropsch derived fuel is generally indicative of low levels of both oxygenates and nitrogen containing compounds, since all are removed by the same treatment processes.

A Fischer-Tropsch derived kerosene fuel is a liquid hydrocarbon middle distillate fuel with a distillation range suitably from 140 to 260° C., preferably from 145 to 255° C., more preferably from 150 to 250° C. or from 150 to 210° C. It will have a final boiling point of typically from 190 to 260° C., for instance from 190 to 210° C. for a typical "narrow-cut" kerosene fraction or from 240 to 260° C. for a typical "full-cut" fraction. Its initial boiling point is preferably from 140 to 160° C., more preferably from 145 to 160° C.

A Fischer-Tropsch derived kerosene fuel preferably has a density of from 0.730 to 0.760 g/cm$^3$ at 15° C.—for instance from 0.730 to 0.745 g/cm$^3$ for a narrow-cut fraction and from 0.735 to 0.760 g/cm$^3$ for a full-cut fraction. It preferably has a sulphur content of 5 ppmw (parts per million by weight) or less. In particular, it has a cetane number of from 63 to 75, for example from 65 to 69 for a narrow-cut fraction, and from 68 to 73 for a full cut fraction.

A Fischer-Tropsch derived gas oil suitably boils for more than 90 vol % between 150 and 380° C. and preferably has a density of from 0.76 to 0.79 g/cm$^3$ at 15° C. It preferably has a sulphur content of 5 ppmw (parts per million by weight) or less. In particular, it has a cetane number of greater than 70 and suitably from 74 to 85, a kinematic viscosity from 2.0 to 4.5, preferably from 2.5 to 4.0, more preferably from 2.9 to 3.7, cSt (mm$^2$/s) at 40° C.

Preferably, more than 5 vol % of the mineral gas oil is separated from said mineral gas oil as an aviation fuel or aviation fuel-blending component. The maximum percentage, which may be separated, will depend on the starting mineral gas oil, the aviation fuel requirements and the properties of the optional mineral kerosene with which this lower cut may be blended. The volume separated from the mineral gas oil may be fully replaced by the Fischer-Tropsch fuel or partly replaced by the Fischer-Tropsch fuel. One may even add more Fischer-Tropsch fuel than the volume of low boiling fraction which is originally separated. It has been found that suitably up to 30 vol % of a Fischer-Tropsch kerosene or up to 40 vol % of a Fischer-Tropsch gas oil may be added. The volume of Fischer-Tropsch fuel added to the mineral gas oil will depend on the density of the mineral gas oil and the availability of optional additional cracked gas oil. It has been found that within the above described ranges an even more preferred compositional range exists. It was found that by adding the Fischer-Tropsch derived fuel component to the mineral gas oil in certain cases this can lead to improved performance in an engine or vehicle running on the resultant blend, as compared to its performance when running on the mineral base fuel alone. This effect is particularly marked at certain concentrations where the increase in cetane number and calorific value due to the Fischer-Tropsch derived component is not yet offset by the decrease it causes in the density of the blend. The effect, manifested for instance by reduced acceleration times, has been observed for blends containing a Fischer-Tropsch derived gas oil, especially at concentrations of from 12 to 18 vol %, and for blends containing a Fischer-Tropsch derived kerosene fuel, especially at concentrations of from 1 to 8 vol %.

The present invention will be illustrated by the following example which are not intended to limit the scope of the claims, but provided for illustrative purposes.

Example 1

From a mineral derived gas oil fraction having the properties as listed in Table 2, 10 vol % of a low boiling fraction B was separated off by distillation. The properties of the low boiling fraction B are listed in Table 3.

TABLE 2

| | | Mineral derived gas oil fraction | Mineral derived gas oil fraction minus 10 vol % kerosene Intermediate product A | EN590 Specification |
|---|---|---|---|---|
| Density @ 15° C. | kg/L | 0.834 | 0.838 | 0.820 to 0.845 |
| Cetane Number | — | 54.3 | 55.5 | ≧51 |
| Cetane Index | IP380 | 54.0 | 54.5 | ≧46 |
| IBP | ° C. | 160 | 175 | |
| T10 | ° C. | 201 | 218 | |
| T50 | ° C. | 277 | 282 | |
| T90 | ° C. | 325 | 328 | |
| T95 | ° C. | 339 | 341 | ≦360 |
| FBP | ° C. | 351 | 351 | |
| D250 | % | 31 | 24 | <65 |
| D350 | % | 99 | 99 | ≧85 |
| Viscosity @ 40° C. | mm$^2$/s (cSt) | 2.69 | 3.01 | 2.0 to 4.5 |
| Sulphur | mg/kg | 35 | 35 | ≦50 |
| Mono Aromatics | % (mass) | 22.8 | 22.9 | |
| Poly-aromatics | % (mass) | 2.7 | 2.7 | ≦11 |
| Total Aromatics | % (mass) | 25.5 | 25.6 | |
| Cloud- | ° C. | −9 | −7 | Climate |

TABLE 2-continued

| | | Mineral derived gas oil fraction | Mineral derived gas oil fraction minus 10 vol % kerosene Intermediate product A | EN590 Specification |
|---|---|---|---|---|
| point | | | | specific |
| Flash-point | ° C. | 65 | 74 | >55 |

TABLE 3

| | | Low boiling fraction B | Jet A1 Check-List |
|---|---|---|---|
| Density @ 15° C. | kg/L | 0.799 | 0.775 to 0.840 |
| IBP | ° C. | 147 | Report |
| T10 | ° C. | 162 | ≦205 |
| T50 | ° C. | 191 | Report |
| T90 | ° C. | 234 | Report |
| T95 | ° C. | 243 | — |
| FBP | ° C. | 260 | ≦300 |
| Viscosity @ −20° C. | $mm^2/s$ (cSt) | 4.20 | ≦8.0 |
| Sulphur | mg/kg | 30 | ≦3000 |
| Aromatics | % (vol) | 24.8 | ≦25 |
| Freezing Point | ° C. | −52 | ≦−47 |
| Flashpoint | ° C. | >38 | ≧38 |

The results in Table 3 show that the low boiling fraction as isolated from the mineral derived gas oil complies with the Jet A1 checklist for use as an aviation kerosene. Obviously this fraction may be blended with other refinery kerosene fractions when preparing an aviation kerosene.

The intermediate product A was blended with 10 vol % (calculated on the blend) of a Fischer-Tropsch derived kerosene and with 10 vol % (calculated on the blend) of a Fischer-Tropsch derived gas oil. The properties of the Fischer-Tropsch blending components are listed in Table 4. The properties of the resultant blends are listed in Table 5.

TABLE 4

| | | Fischer-Tropsch derived kerosene (GTL Kero) | Fischer-Tropsch derived gas oil (GTL Diesel) |
|---|---|---|---|
| Density @ 15° C. | kg/L | 0.736 | 0.785 |
| IBP | ° C. | 152 | 212 |
| T10 | ° C. | 170 | 249 |
| T50 | ° C. | 206 | 298 |
| T90 | ° C. | 232 | 339 |
| T95 | ° C. | 238 | 349 |
| FBP | ° C. | 248 | 355 |
| Viscosity @ 40° C. | $mm^2/s$ (cSt) | 1.0 | 3.6 |
| Sulphur | mg/kg | <10 | <10 |
| Total Aromatics | % (mass) | 0.1 | 0.1 |
| Cloudpoint | ° C. | −48 | 1 |
| Flashpoint | ° C. | 48 | 91 |

TABLE 5

| | | Intermediate product A with 10% GTL Kero | Intermediate product A with 10% GTL Diesel | EN590 Specification |
|---|---|---|---|---|
| Density @ 15° C. | kg/L | 0.827 | 0.832 | 0.820 to 0.845 |
| Cetane Number | — | 56.7 | 57.5 | ≧51 |
| Cetane Index | IP380 | 57.2 | 57.4 | ≧46 |

TABLE 5-continued

| | | Intermediate product A with 10% GTL Kero | Intermediate product A with 10% GTL Diesel | EN590 Specification |
|---|---|---|---|---|
| IBP | ° C. | 163 | 177 | |
| T10 | ° C. | 205 | 220 | |
| T50 | ° C. | 277 | 283 | |
| T90 | ° C. | 325 | 330 | |
| T95 | ° C. | 339 | 342 | ≦360 |
| FBP | ° C. | 351 | 351 | |
| D250 | % | 32 | 23 | <65 |
| D350 | % | 99 | 99 | ≧85 |
| Viscosity @ 40° C. | $mm^2/s$ (cSt) | 2.63 | 3.06 | 2.0 to 4.5 |
| Sulphur | mg/kg | 32 | 32 | ≦50 |
| Mono Aromatics | % (mass) | 20.9 | 20.8 | |
| Polyaromatics | % (mass) | 2.4 | 2.4 | ≦11 |
| Total Aromatics | % (mass) | 23.3 | 23.2 | |
| Cloudpoint | ° C. | −9 | −6 | Climate specific |
| Flashpoint | ° C. | 68 | 75 | >55 |

The invention claimed is:

1. A process to prepare an aviation fuel and an automotive as oil from a source of mineral derived gas oil, the process comprising:

separating from the source of mineral derived as oil a low boiling fraction boiling for more than 90 vol % at from 130 to 300° C. and has a density of from 775 to 840 $kg/m^3$, the low boiling fraction being suitable for use as an aviation fuel or as an aviation fuel component; and blending the remaining part of the source of mineral derived gas oil with a Fischer-Tropsch derived kerosene fraction having a distillation range of from 140 to 260° C., a density of from 0.73 to 0.760 $gm/cm^3$ at 15° C. and a cetane number of from 63 to 75 and/or a Fischer Tropsch derived gas oil fraction boiling for more than 90 vol % between 150 and 380° C., a density of from 0.76 to 0.79 $g/cm^3$ at 15° C. and a cetane number of greater than 70; thereby providing a resultant blend suited for use as at least part of an automotive gas oil meeting applicable fuel specifications comprising a density of from 820 to 845 $kg/m^3$ at 15° C. and a cetane number of above 51.

2. The process of claim 1 comprising blending the remaining part of the source of mineral derived gas oil with 30 vol. % or less of the Fischer-Tropsch derived kerosene fraction.

3. The process of claim 1 further comprising adding to the resultant blend additional cracked gas oil blending component while maintaining the applicable fuel specifications.

4. The process of claim 1 further comprising blending the low boiling fraction with a mineral derived kerosene fraction.

5. The process of claim 1 wherein the resultant blend comprises from about 1 to 8 vol % of the Fischer-Tropsch derived kerosene fraction.

6. A process to prepare an aviation fuel and an automotive gas oil from a source of mineral derived gas oil, the process comprising:

separating from the source of mineral derived gas oil a low boiling fraction boiling for more than 90 vol % at from 130 to 300° C., the low boiling fraction being suitable for use as an aviation fuel or as an aviation fuel component; and blending the remaining part of the source of mineral derived gas oil with about 40 vol. % or less of a Fischer-Tropsch derived kerosene fraction having a distillation range of from 140 to 260° C., thereby providing a resultant blend suited for use as at least part of an automotive as oil meeting applicable fuel specifications wherein the resultant blend comprises from about 12 to 18 vol % of a Fischer-Tropsch derived gas oil fraction boiling for more than 90 vol % between 150 and 380° C. and having a density of from 0.76 to 0.79 g/cm$^3$ at 15° C., and a cetane number of greater than 70.

7. A process to prepare an aviation fuel and an automotive gas oil from a source of mineral derived gas oil, the process comprising:

separating from the source of mineral derived gas oil a low boiling fraction boiling for more than 90 vol % at from 130 to 300° C., has a density of from 775 to 840 kg/m$^3$, the low boiling fraction being suitable for use as an aviation fuel or as an aviation fuel component; and blending the remaining part of the source of mineral derived gas oil with about 40 vol. % or less of a Fischer-Tropsch derived kerosene fraction having a distillation range of from 140 to 260° C., has a density of from 0.73 to 0.760 gm/cm$^3$ at 15° C. and a cetane number of from 63 to 75, thereby providing a resultant blend suited for use as at least part of an automotive gas oil meeting applicable fuel specifications comprising a density of from 820 to 845 kg/m$^3$ at 15° C. and a cetane number of above 51.

8. The process of claim 7 wherein the resultant blend comprises from about 1 to 8 vol % of the Fischer-Tropsch derived kerosene fraction.

9. The process of claim 8 wherein the resultant blend comprises from about 12 to 18 vol % of a Fischer-Tropsch derived gas oil fraction boiling for more than 90 vol % between 150 and 380° C. and having a density of from 0.76 to 0.79 g/cm$^3$ at 15° C., and a cetane number of greater than 70.

10. The process of claim 7 further comprising adding to the resultant blend additional cracked gas oil blending component while maintaining the density specifications for the resultant blend.

11. The process of claim 7 further comprising blending the low boiling fraction with a mineral derived kerosene fraction.

12. A process to prepare an aviation fuel and an automotive gas oil from a source of mineral derived gas oil, the process comprising:

separating from the source of mineral derived gas oil a low boiling fraction boiling for more than 90 vol % at from 130 to 300° C., the low boiling fraction being suitable for use as an aviation fuel or as an aviation fuel component; and blending the remaining part of the source of mineral derived gas oil with about 40 vol. % or less of a Fischer-Tropsch derived gas oil fraction boiling for more than 90 vol % between 150 and 380° C., thereby providing a resultant blend suited for use as at least part of an automotive gas oil meeting applicable fuel specifications, wherein the resultant blend comprises from 1 to 8 vol % of a Fischer-Tropsch derived kerosene fraction having a density of from 0.73 to 0.760 gm/cm$^3$ at 15° C. and a cetane number of from 63 to 75.

13. The process of claim 12 wherein the resultant blend comprises from 12 to 18 vol % of the Fischer-Tropsch derived gas oil fraction.

14. The process of claim 13 wherein:

the low boiling fraction has a density of from 775 to 840 kg/m$^3$;

the Fischer Tropsch derived gas oil fraction has a density of from 0.76 to 0.79 g/cm$^3$ at 15° C. and a cetane number of greater than 70; and, the applicable fuel specifications comprise a density of from 820 to 845 kg/m$^3$ at 15° C. and a cetane number of above 51.

15. A process to prepare an aviation fuel and an automotive as oil from a source of mineral derived gas oil, the process comprising:

separating from the source of mineral derived gas oil a low boiling fraction boiling for more than 90 vol % at from 130 to 300° C., has a density of from 775 to 840 kg/m$^3$, the low boiling fraction being suitable for use as an aviation fuel or as an aviation fuel component; and blending the remaining part of the source of mineral derived gas oil with about 40 vol. % or less of a Fischer-Tropsch derived as oil fraction boiling for more than 90 vol % between 150 and 380° C., has a density of from 0.76 to 0.79 g/cm$^3$ at 15° C. and a cetane number of greater than 70, thereby providing a resultant blend suited for use as at least part of an automotive as oil meeting applicable fuel specifications, the applicable fuel specifications comprise a density of from 820 to 845 kg/m$^3$ at 15° C. and a cetane number of above 51.

* * * * *